US011486061B2

(12) United States Patent
Günther et al.

(10) Patent No.: US 11,486,061 B2
(45) Date of Patent: Nov. 1, 2022

(54) COMPACTOR DEVICE

(71) Applicant: SAURER SPINNING SOLUTIONS GmbH & CO. KG, Übach-Palenberg (DE)

(72) Inventors: Karoline Günther, Mönchengladbach (DE); Thomas Weide, Mönchengladbach (DE); Roland Werner, Krefeld (DE)

(73) Assignee: Saurer Spinning Solutions GmbH & Co. KG, Übach-Palenberg (DE)

( * ) Notice: Subject to any disclaimer, the term of this patent is extended or adjusted under 35 U.S.C. 154(b) by 24 days.

(21) Appl. No.: 16/650,786

(22) PCT Filed: Sep. 24, 2018

(86) PCT No.: PCT/EP2018/075750
§ 371 (c)(1),
(2) Date: Mar. 25, 2020

(87) PCT Pub. No.: WO2019/063461
PCT Pub. Date: Apr. 4, 2019

(65) Prior Publication Data

US 2020/0224338 A1 Jul. 16, 2020

(30) Foreign Application Priority Data

Sep. 26, 2017 (DE) ..... 10 2017 122 318.5

(51) Int. Cl.
*D01H 5/72* (2006.01)

(52) U.S. Cl.
CPC ..... *D01H 5/72* (2013.01)

(58) Field of Classification Search
None
See application file for complete search history.

(56) References Cited

U.S. PATENT DOCUMENTS 2,091,153 A 8/1937 Martin
2,228,794 A * 1/1941 Taine ..... D01H 5/72 19/157
2,450,251 A * 9/1948 Noguera ..... D01H 5/72 19/157

(Continued)

FOREIGN PATENT DOCUMENTS

CH 180935 A 11/1935
CN 101285224 A 10/2008

(Continued)

OTHER PUBLICATIONS

International Search Report of corresponding application PCT/EP2018/075750, dated Dec. 13, 2018, all enclosed pages cited.

*Primary Examiner* — Shaun R Hurley
(74) *Attorney, Agent, or Firm* — Nelson Mullins Riley & Scarborough LLP

(57) ABSTRACT

A compactor device for compacting a sliver that is drawn by a drafting system of a textile machine is provided. In accordance with the invention, it is envisaged that the compactor device is designed as a channel compactor and has a guide channel, designed in the shape of a screw in the running direction of the sliver, wherein the entry opening of the guide channel is widest horizontally and the exit opening of the guide channel is arranged rotated at least 30° with respect to the entry opening.

12 Claims, 6 Drawing Sheets

(56) References Cited

U.S. PATENT DOCUMENTS

Figure 1:
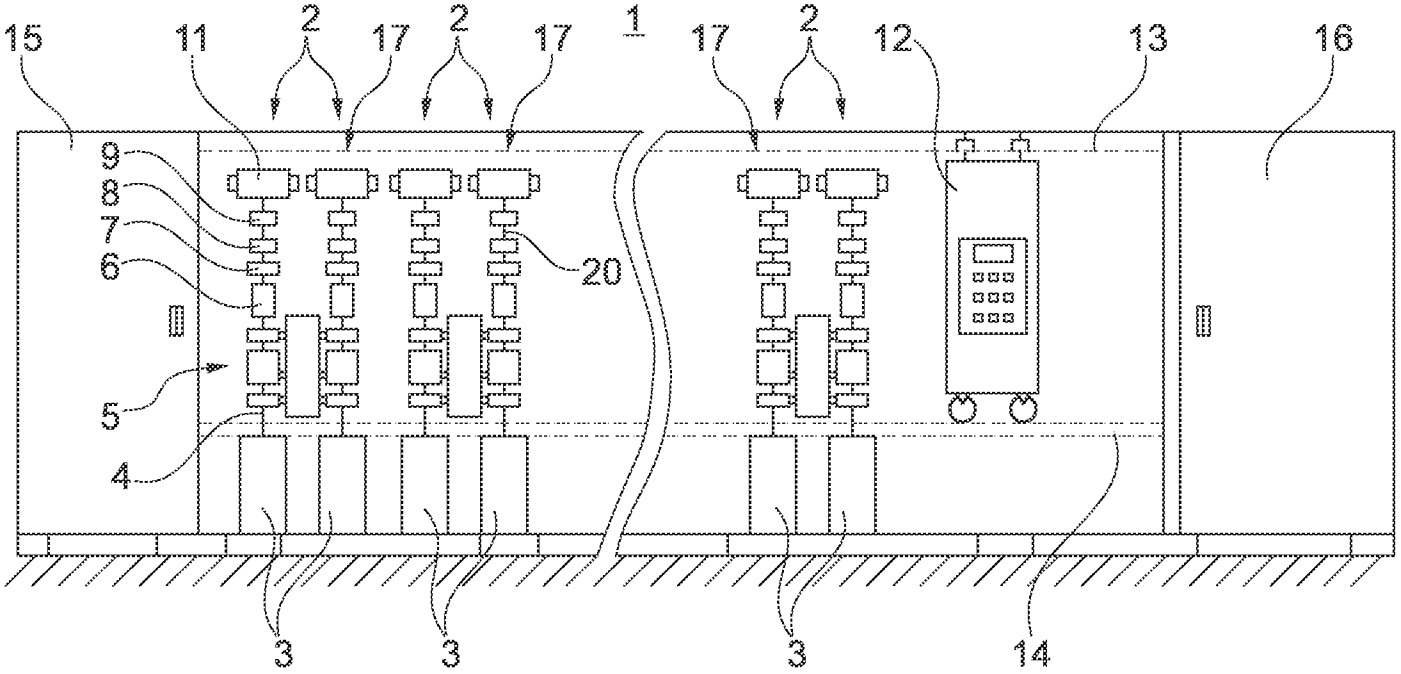

| | | | | | |
|---|---|---|---|---|---|
| 2,640,229 | A * | 6/1953 | Gwaltney | D01H 5/72 | 19/157 |
| 2,755,514 | A * | 7/1956 | Noguera | D01H 5/72 | 19/291 |
| 3,133,320 | A * | 5/1964 | Swanson | D01H 5/72 | 19/288 |
| 4,301,574 | A * | 11/1981 | Zhestkov | D01H 5/72 | 19/288 |
| 4,445,252 | A * | 5/1984 | Morihashi | D01H 5/72 | 19/244 |
| 4,497,089 | A * | 2/1985 | Anahara | D01H 5/72 | 19/246 |
| 4,894,886 | A * | 1/1990 | Morihashi | D01H 5/005 | 19/244 |
| 5,829,101 | A * | 11/1998 | Denz | D01H 5/72 | 19/288 |
| 6,209,304 | B1 * | 4/2001 | Feuerlohn | D01H 4/38 | 57/328 |
| 6,216,433 | B1 * | 4/2001 | Stahlecker | D01H 1/025 | 19/150 |
| 2007/0022729 | A1 * | 2/2007 | Weide | D01H 4/02 | 57/350 |
| 2018/0238480 | A1 * | 8/2018 | Scott | F16L 37/36 | |
| 2020/0263328 | A1 * | 8/2020 | D'Agnolo | D02J 1/08 | |

FOREIGN PATENT DOCUMENTS

| | | | |
|---|---|---|---|
| DE | 1712714 | U | 12/1955 |
| DE | 2946722 | A1 | 5/1981 |
| DE | 19514997 | A1 | 10/1996 |
| DE | 19926492 | A1 | 4/2000 |
| DE | 102011015748 | A1 | 10/2012 |
| DE | 102013017636 | A1 | 4/2015 |
| DE | 102015110980 | A1 | 1/2017 |
| EP | 2740821 | A1 | 6/2014 |
| FR | 853923 | A1 | 4/1940 |
| JP | H0314237 | U | 2/1991 |
| JP | H5347130 | A | 12/1993 |

* cited by examiner

COMPACTOR DEVICE

CROSS-REFERENCE TO RELATED APPLICATIONS

This application claims priority from PCT International Patent Application No. PCT/EP2018/075750, filed Sep. 24, 2018, which claims priority from German National Patent Application No. 10 2017 122 318.5, filed Sep. 26, 2017, entitled "Verdichtereinrichtung", the entire contents of which are incorporated herein by reference.

FIELD OF THE INVENTION

The invention generally relates to a compactor device, more particularly to a compactor device for compacting a sliver that is drawn by a drafting system of a textile machine.

BACKGROUND OF THE INVENTION

Both drafting systems and associated compaction devices have long been well-known in the context of textile machines.

The known drafting systems are arranged in front of each of the spinning units of the textile machine, and they draw a material supplied to them, usually a sliver or roving frame fibre, to a desired fineness. These kinds of drafting systems have several pairs of rollers lying one in front of the other in the running direction of the sliver that rotate at different circumferential speeds and transport the sliver to the associated spinning unit.

Because the circumferential speed of the roller pairs increases in the running direction of the sliver, the sliver is constantly accelerated within the drafting system, thus undergoing a so-called draft warp. With known drafting systems, the total draft of the sliver differs greatly depending on the textile machine in question.

For the drafting systems of air spinning machines, the total draft of the sliver can be up to 180 times, while the drafting systems of pre-spinning machines, for example roving frames, usually work with significantly lower total drafting.

Among other things, the compactness and hairiness of the drafted sliver has a decisive influence on the quality of the yarn material supplied by the drafting system. This means that, when it is running into the drafting system, the sliver has a width that is first reduced to a significantly narrower width during the course of the drafting process. On the outgoing side of the drafting system, in the area of the so-called spinning triangle, there should be a width that is once again significantly lower than the intermediate width of the material running in.

During the drafting process, however, there is the problem that edge fibres are often either not bound in and increased peeling away of fibres occurs, or the edge fibres are bound in a disorganized way, leading to increased hairiness and an increased width of the spinning triangle, and therefore to a reduction in quality of the drafted sliver.

In order to achieve a secure guidance and as good a compacting of the sliver as possible during the drafting of the material in question, the known drafting systems often also have so-called compaction units.

In German Patent Publication DE 10 2011 015 748 A1, for example, a drafting system for a pre-spinning machine is described that has a pre-drafting field, a main drafting field and a downstream compaction zone.

A compaction unit is positioned in the compaction zone, which is described as a condenser component ("Kondenserbauteil") in German Patent Publication DE 10 2011 015 748 A1. The condenser component has a guide slit that opens upward for the sliver, where the guide slit is significantly higher than it is wide. The condenser component serves to homogenise the thickness of the sliver and reduce the hairiness of the sliver, which means that the quality of the material is improved.

In German Patent Publication DE 10 2013 017 636 A1, in addition, drafting systems for the air spinning units of air spinning machines are known that are fitted with comparable compaction units.

One of the depicted embodiments shows and describes a drafting system that is designed as a so-called four-roller drafting system, and that has a pre-drafting field, a mid-drafting field and a main drafting field.

With this known four-roller drafting system, a pre-compactor is positioned in front of the input roller pair of the drafting system, and a second compactor is positioned in the pre-drafting field. Moreover, the main drafting field of the drafting system is equipped with a third compactor.

For this known drafting system too, the compaction units are designed to reduce the hairiness of the stretched sliver and increase the number of entwined fibres.

A four-roller drafting system for the air spinning units of air spinning machines is also described in German Patent Publication DE 10 2015 110 980 A1.

This known drafting system is also fitted with a special device for improving the quality of the drafted sliver. This means that, with this four-roller drafting system, a false spinning component is positioned in the pre-drafting field of the drafting system, which twists the sliver with alternating twist directions, before it is pulled to the desired yarn fineness in the main draft field and guided to an air spinning unit.

The alternating twisting direction of the sliver is intended to minimize edge fibres being diverted, which occurs in particular due to the air stream in the area of the output rollers of the drafting system, which rotate at a relatively higher speed.

Although the drafting systems described above have different options for improving the quality of a concealed sliver, they can have the problem that, when pulling the sliver, edge fibres occur or the sliver has insufficient compactness, so that on the output side of the drafting system a relatively wide spinning triangle occurs, which cannot be completely alleviated.

SUMMARY OF THE INVENTION

Given the above-mentioned state of the art, the invention has the task of developing a compactor device or unit for one of the drafting systems positioned in front of the spinning device of a textile machine that is designed so that during the drafting process it is ensured that the width of the sliver to be drafted is reliably minimized both in the main drafting area and in the area of the spinning triangle occurring on the output side of the drafting system.

In accordance with the invention, this task is completed by a compactor device that is designed as a channel compactor and has a guide channel designed in the shape of a screw in the running direction of the sliver, where in the entry opening of the guide channel is widest horizontally and the exit opening of the guide channel is arranged rotated with respect to the entry opening.

Advantageous embodiments of the invention are set forth in detail herein.

The design of a channel compactor in accordance with the invention has the particular advantage that the guided sliver, which initially runs in a flat horizontal direction into the entry opening of the guide channel of the channel compactor, is turned somewhat within the channel compactor, temporarily creating a false twist. This means that, when it is running out of the guide channel of the channel compactor, the sliver is rotated so that in the following draft roller pair, the edge fibres are immediately compacted, thereby leading to an initial compacting of the sliver.

This means that, through the compacting of the twisted sliver, the edge fibres are bound in to a high degree, which not only reduces the peeling away of fibres, but also minimizes the width of the spinning triangle, with the result that there is an overall increase in the quality of the material produced.

In the advantageous embodiment, it is envisaged that the rotation angle between the entry opening and the exit opening of the guide channel of the channel compactor is between 30° and 160°, and preferably 90°.

Due to this rotated positioning of the entry and exit opening of the guide channel, the sliver not only temporarily receives a so-called false spin, which leads to a positive stabilisation of the materials, but also preparation is done for further compacting by the downstream drafting rollers.

It has proven especially advantageous if the sliver is twisted by 90°, i.e. if the sliver that is originally running on a horizontal direction in the guide channel of the channel compactor is twisted in a vertical direction and runs into the downstream drafting system roller pair in this direction.

In the most advantageous embodiment it is moreover envisaged that the guide channel has a light cross-section area, which is depicted through two narrowing ellipses extending towards the centre from both sides.

Numerous trials have shown that in such a design, the guide channel cross-section can always ensure an even and secure guidance of the sliver in the depicted screw-shaped guide channel.

The channel compactor is preferably manufactured from an abrasion-resistant plastic in a 3D printing process. Polyamides have proven to be advantageous as plastics, these can be designed in almost any three-dimensional shape using fused deposition modelling. This means that the manufacturing of the channel compactor in a 3D printing process in accordance with the invention represents an advantageous, relatively simple manufacturing method.

The channel compactor in accordance with the invention can be manufactured in another 3D printing process.

Regarding the installation position of the channel compactor in accordance with the invention, various locations are possible.

For drafting systems of textile machines that work with relatively high draft values, such as the drafting systems of air spinning machines, positioning of the channel compactor in accordance with the invention can be advantageous both in the area of the pre-draft field of the drafting system and in the area of the mid-draft field of the drafting system of the air spinning unit.

Such a positioning keeps the distance between the channel compactor and the exit roller pair of the drafting system relatively small, which has a very positive effect on the development of the width of the spinning triangle that occurs at the exit side of the exit roller pair of the drafting system.

In the context of drafting systems for air spinning units, however, it has emerged that positioning the channel compactor in front of the entry roller pair of the drafting system or a simultaneous positioning of several channel compactors at various positions of a drafting system can be very advantageous.

Particularly for the simultaneous positioning of several channel compactors, multiple compacting of the twisted sliver, that is also processed by the roller pair of the drafting system, occurs so that the width of the sliver set in the area of the drafting system and in the area of the spinning triangle is minimized.

Various positions of the channel compactor can be advantageous in accordance with the invention, including for textile machines for which their drafting systems work with relatively low draft values, for example for roving frames.

In tests it emerged that, for example, both a positioning of the channel compactor in front of the entry roller pair of the drafting system as well as a positioning of the channel compactor in the area of the pre-draft field of the drafting system are very advantageous.

It was shown, for example, that with such a positioning of the channel compactor with the drafting systems, roving flyers can be created that are significantly more compact and less hairy than previously known roving fibres.

This means that, with the drafting systems of roving frames in which a channel compactor is arranged front of the entry roller pair of the drafting system in the area of the pre-draft field of the drafting system, roving fibres can be created that have significant advantages during their further processing by ring spinning machines.

These improved roving fibres meant, for example, that spinning triangles were set up at the drafting systems of the ring spinning machines during the spinning process that were significantly lesser in width than the previously standard spinning triangles, which is a good sign for the excellent quality of the drafted sliver.

Also regarding the exact design of the guide channel of the channel compactor, various types of embodiment are possible.

In an initial embodiment type, the guide channel of the channel compactor can, for example, be designed so that it has its maximum width in the area of its horizontally positioned entry opening. This maximum width then reduces through the guide channel and has its final minimum width in the area of the exit opening, which is arranged rotated in a vertical direction compared to the entry opening.

In another advantageous embodiment, the guide channel of the channel compactor has a width in the area of its horizontally positioned entry opening that "grows" throughout the length of the guide channel, having its maximum width in the area of the exit opening, which is arranged rotated in a vertical direction compared to the entry opening.

Which of the above described embodiments is more advantageous can depend on a number of factors, for example the material of the sliver or roving fibres, the desired fineness of the drafted material, the degree of sliver drafting, etc.

DETAILED DESCRIPTION OF THE DRAWINGS

The invention is explained in greater detail below on the basis of embodiment examples shown in the drawings.

Figure 2:
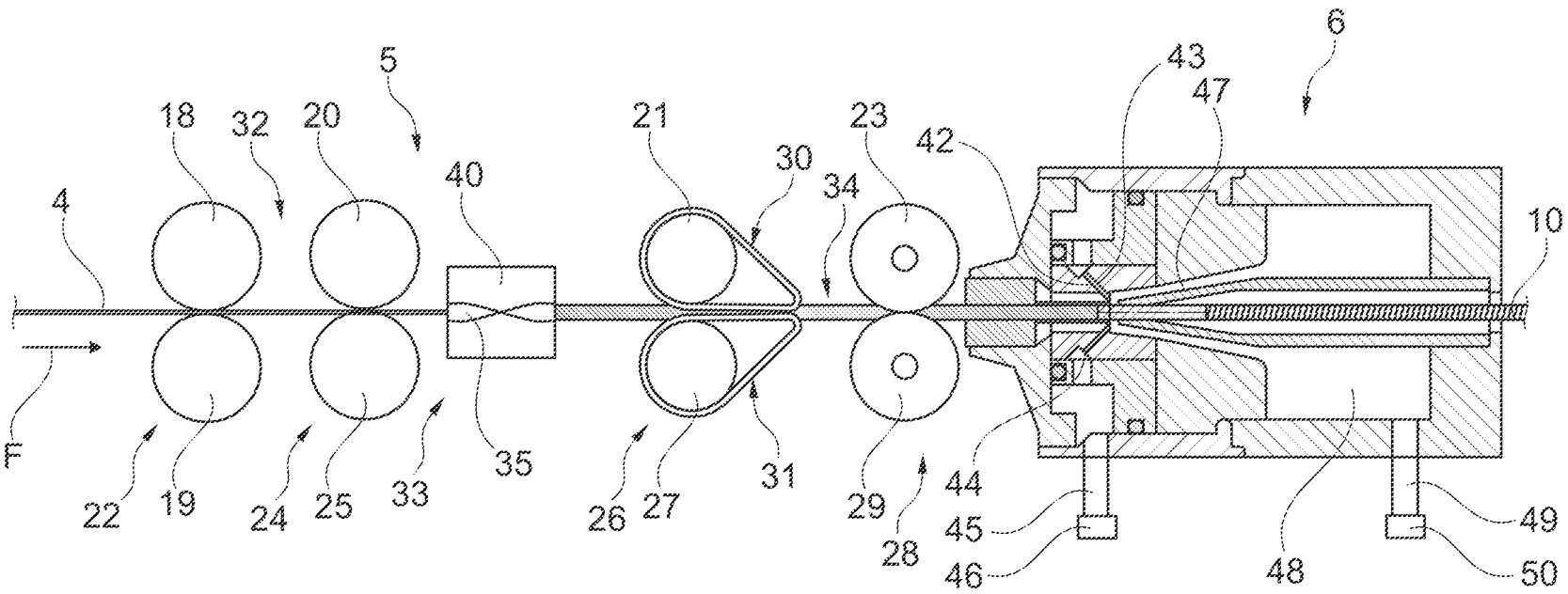
Figure 3:
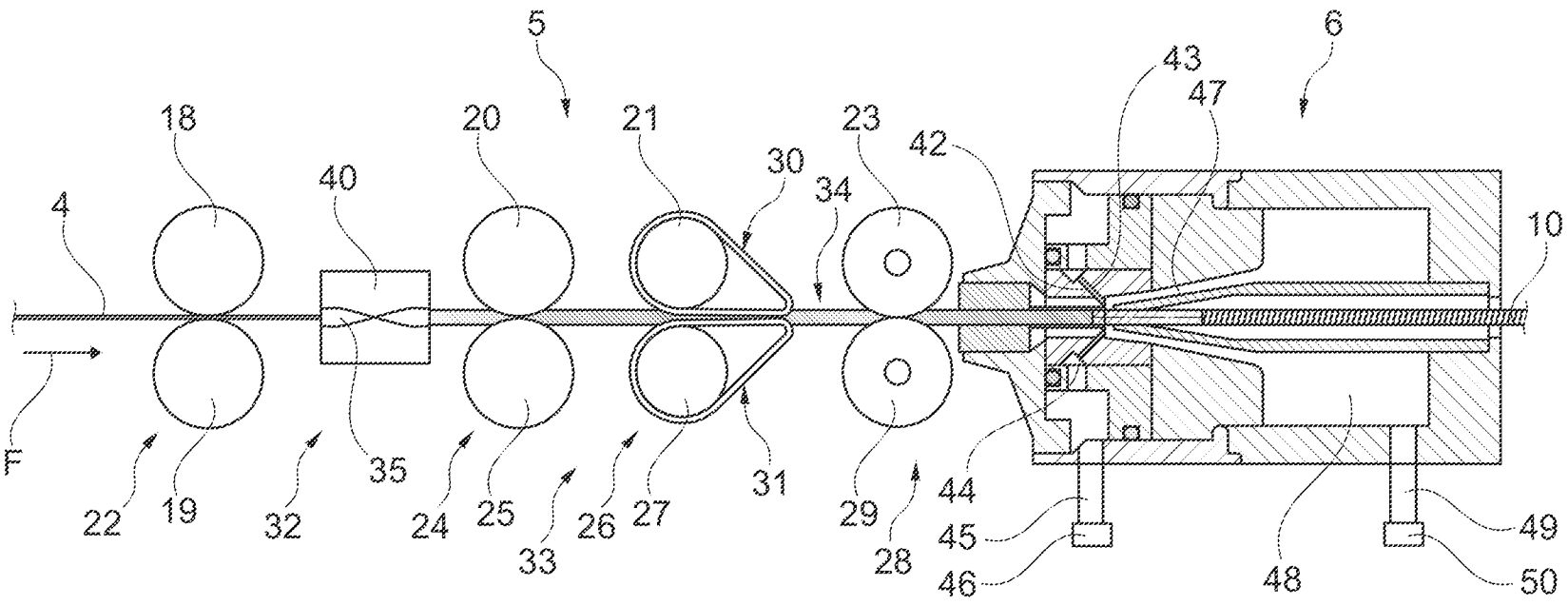
Figure 4:
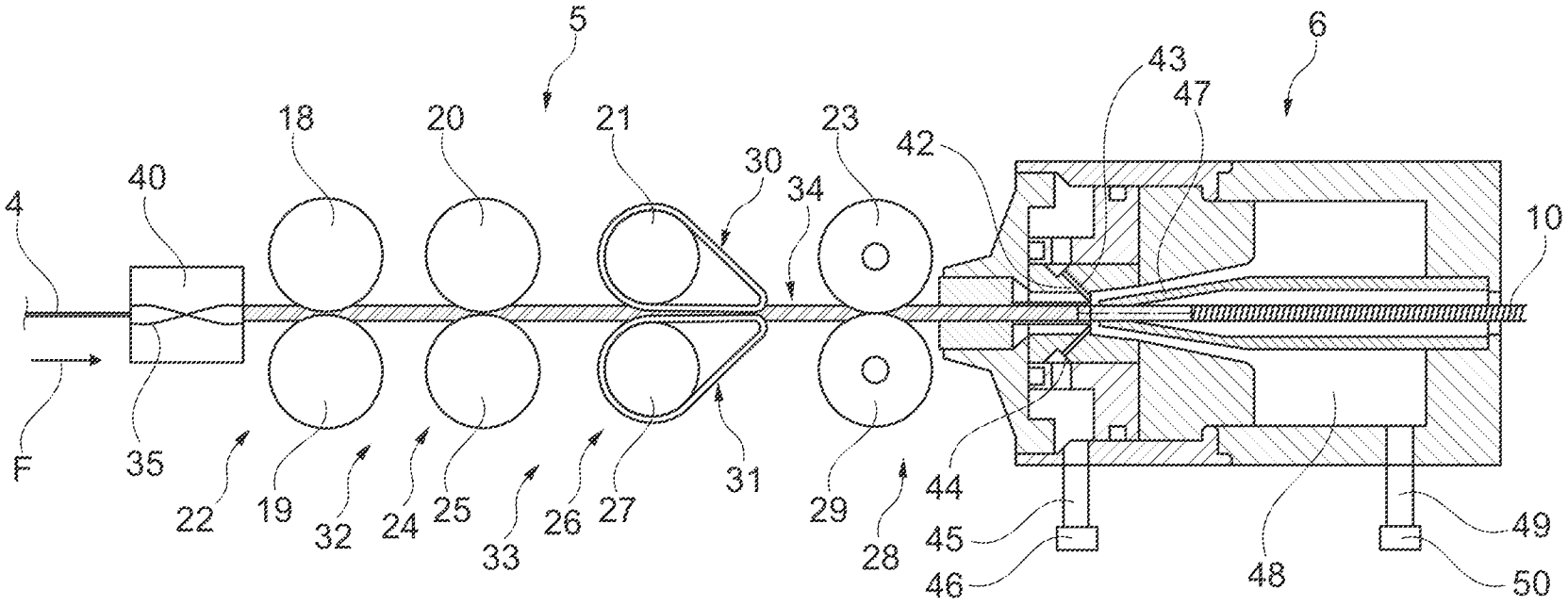
Figure 5:
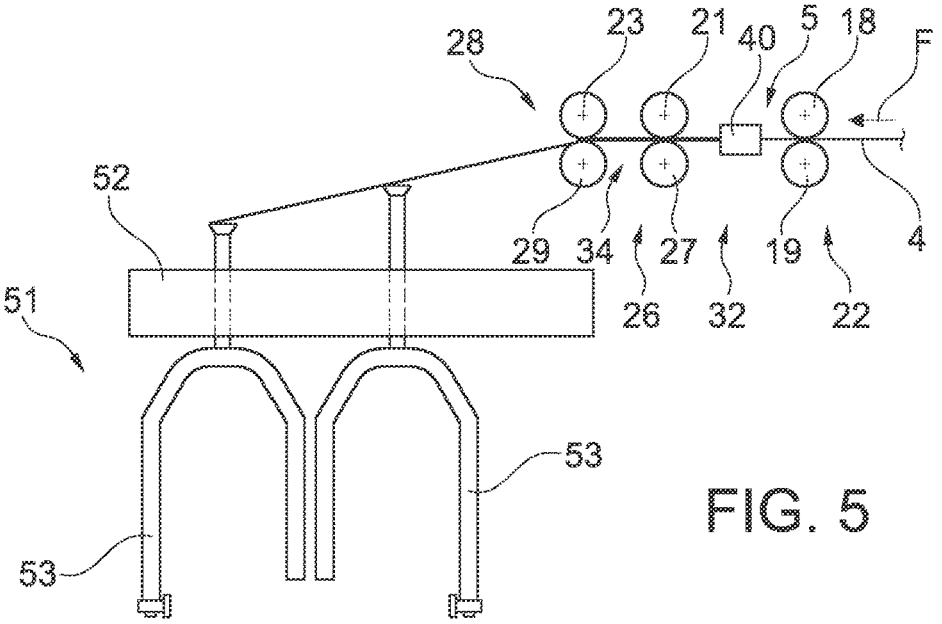
Figure 6:
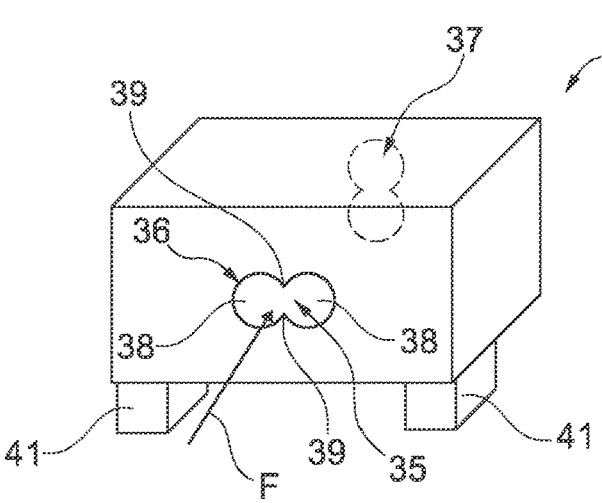
Figure 7:
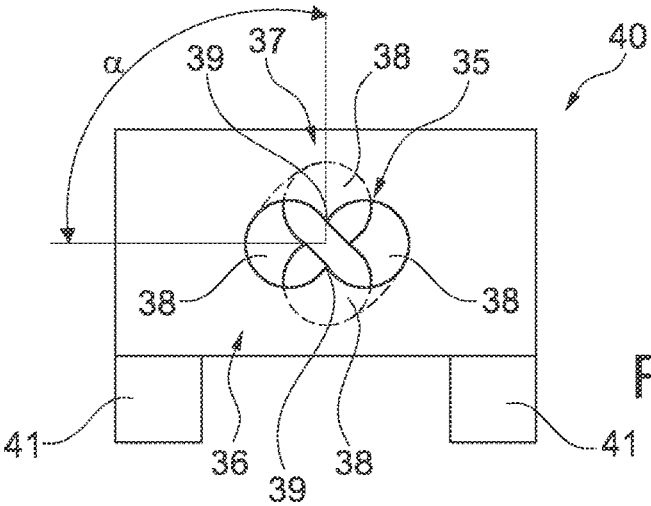
Figure 8:
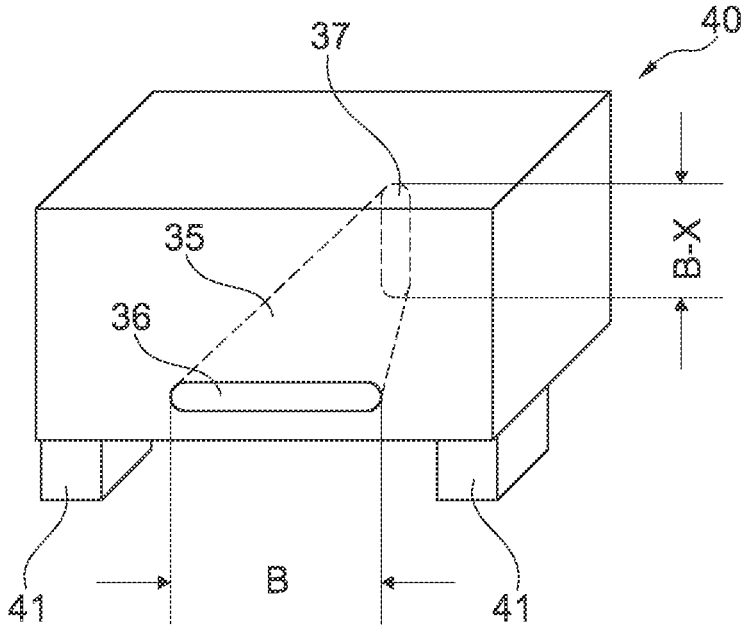
Figure 9:
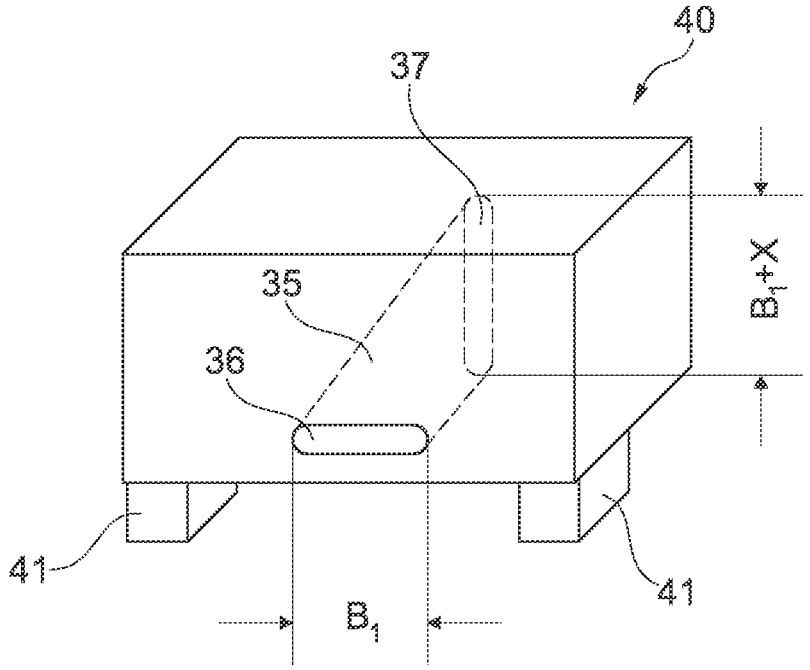

The figures show:

FIG. 1 is a schematic front view of an air spinning machine with a number of spinning positions, each of which has an air spinning unit with an upstream drafting system, FIG. 2 is a side view of a drafting system shown as a four-roller drafting system positioned in front of an air spinning unit, with a channel compactor in accordance with the invention in the area of the mid-drafting field, FIG. 3 is a side view of a four-roller drafting system as in FIG. 2, with a channel compactor in accordance with the invention in the area of the pre-drafting field of the drafting system, FIG. 4 is a side view of a four-roller drafting system as in FIG. 2, with a channel compactor in accordance with the invention in front of the entry roller pair of the drafting system, FIG. 5 is a side view of a workstation of a roving frame, with a three-roller drafting system, that has a channel compactor in accordance with the invention in the area of the pre-drafting field of the drafting system, FIG. 6 is a perspective view of a first embodiment in accordance with the invention, FIG. 7 is a front view of the channel compactor as in FIG. 6, FIG. 8 is a view of another embodiment of the channel compactor in accordance with the invention, and FIG. 9 is a view of another embodiment of the channel compactor in accordance with the invention.

DETAILED DESCRIPTION OF THE DRAWINGS

FIG. 1 shows a schematic front view of an air spinning machine 1. As shown, these types of air spinning machines 1 have a number of workstations 2 positioned in a row next to one another between their so-called end stations 15, 16 at their end sides, which are often also designated as spinning positions.

Material is processed on these spinning positions 2, for example sliver 4 stored in a spinning can 3. This means that sliver 4 is spun into a yarn at this spinning position 2.

For this purpose, spinning position 2 has various devices. The spinning positions 2 each have, for example, a drafting system 5, an air spinning unit 6, a thread drafting device 7, a yarn clearer 8 and a winding device 11.

The drafting system 5, which can, for example, be designed as a four-roller drafting system or as a three-roller drafting system, also has a channel compactor in accordance with the invention, which is not represented in FIG. 1 for reasons of improved clarity. This channel compactor 40 is explained below in detail using FIGS. 2 to 9.

As indicated in FIG. 1, the yarn prepared in the air spinning unit 6 from sliver 4 is wound by an associated thread changing device 9 in cross-wound layers onto a take-up package 17, creating a cross-wound package.

The cross-wound package 17 is held, in the usual way, in a package cradle (not shown) and is rotated during the spinning process by a package drive (also not shown).

As further represented in FIG. 1, the workstations 2 of the air spinning machine 1 are supplied by an independently working operating unit 12, that can be moved on rails 13, 14 along the workstations depicted as spinning positions 2.

The FIGS. 2, 3 and 4 each show a positioning option of a channel compactor 40 in accordance with the invention positioned in the area of a drafting system 5.

In the embodiment examples, the drafting system 5, that drafts a sliver 4, is depicted as a four-roller drafting system and is arranged in front of an air spinning unit 6 of an air spinning machine 1.

In accordance with FIG. 2, the channel compactor 40 in accordance with the invention is positioned in the area of the so-called mid-draft field 33.

As can be seen, a sliver 4 that is drawn from a (not shown) spinning can 3 by an intake roller pair 22, which consists of an upper roller 18 and a lower roller 19, is drawn into drafting system 5, and is finally transported to air spinning unit 6 and drafted by means of the additional pairs 24, 26, 28.

The roller pairs 24, 26, 28 are each consisting of an upper roller 20 and a lower roller 25, and upper roller 21 and a lower roller 27 or an upper roller 23 and a lower roller 29. The upper roller 21 and the lower roller 27 each work together with one of the aprons 30 or 31, which are positioned in the area of the so-called main drafting field 34. The upper roller 23 and the lower roller 29 represent the exit roller pair 28 of the drafting system 5. This means that, in the present four-roller drafting system 5, the first two roller pairs 22, 24 represent a pre-drafting field 32 for the sliver 4, looked at in running direction F of the sliver 4. The following drafting system section between the roller pair 24 and the roller pair 26 form a so-called mid-drafting field 33, in which the channel compactor 40, designed in accordance with the invention, is also positioned, while the roller pairs 26, 28, as indicated above, form the main drafting field 34 of the drafting system 5.

As can be seen, the sliver 4 is transported to air spinning unit 6 by the roller pairs 22, 24, 26 and 28.

Because the circumferential speeds of the roller pairs 22, 24, 26, 28 increase in the running direction F of the sliver, the sliver 4 is drafted during transport.

The drafting of the sliver 4 can be up to 180 times its original length.

As is moreover shown in FIG. 2, the air spinning aggregate 6 has a nozzle device 42 on its input side, the nozzles 43, 44 of which are connected with a pressurised air source 46 via a pneumatic line 45. A hollow spinning cone 47 is connected to the nozzle device 42, which is surrounded by an air chamber 48, which is connected with a low pressure source 50 via an additional pneumatic line 49.

During the spinning operation, the air emerging from the nozzles 43, 44 creates a rotation flow, which hits the drafted sliver 4. This means that, through the cooperation of the nozzle device 42 and spinning cone 47, a yarn 10 is formed in the air spinning unit 6 that is drawn from the air spinning device 6 through the hollow spinning cone 47.

Further details on the spinning process using this type of air spinning unit 6 can be found in German Patent Publication DE 199 26 492 A1, for example.

The channel compactor 40, designed in accordance with the invention and in accordance with the embodiment example of FIG. 2, positioned in the area of the mid-drafting field 33, ensures that during the drafting process the sliver 4, which runs into the drafting system 5 in a flat horizontal direction, is turned in the channel compactor 40 in e.g. a vertical direction by means of its screw-shaped guide channel 35. The sliver 4 thereby temporarily receives a false twist, which leads to the compacting of the sliver 4 on all sides.

This compacting of the sliver 4 on all sides is not only maintained during the passage of the sliver 4 through the drafting system 5, but rather is enhanced even further in drafting system 5.

The embodiment example depicted in FIG. 3 differs from the embodiment example depicted in FIG. 2 only in the positioning of the channel compactor 40 in the area of the drafting system 5 in accordance with the invention.

As can be seen, in the embodiment example in FIG. 3 the channel compactor 40 in accordance with the invention is positioned in the area of the pre-drafting field 32 of the drafting system 5.

Even with such a positioning of the channel compactor 40, the sliver 4 temporarily receives a false twist and is thereby compacted on all sides.

The embodiment example depicted in FIG. 4 also essentially differs from the embodiment examples depicted in FIGS. 2 and 3 in the positioning of the channel compactor 40 in the area of the drafting system 5 in accordance with the invention.

As can be seen, in this embodiment example the channel compactor 40 in accordance with the invention is positioned in front of the entry roller pair 22 of the drafting system 5. Such a positioning of the channel compactor 40 means that the sliver 4 is already turned in, for example, a vertical direction from a flat horizontal position before it enters drafting system 5.

Even with a positioning of the channel compactor 40 in front of the entry roller pair 22 of the drafting system 5, the sliver 4 temporarily receives a false twist and is thereby compacted on all sides.

The further integration of the edge fibres into the sliver 4 that is associated with the compacting of the vertically positioned sliver 4 not only leads to an improvement in the quality of the sliver 4 running into the air spinning unit, but also leads to a significant reduction in the peeling away of fibres that occurs during the spinning process.

FIG. 5 shows a strongly schematic side view of a workstation of a pre-spinning machine, in the represented embodiment example, the workstation of a so-called roving frame 51.

As is generally known, slivers 4 that are not rotated are drafted using roving frames such as roving frame 51, and thereby processed into roving threads that already have some yarn rotation.

These roving threads with some yarn rotation are then spun into fine yarns in textile machines further downstream in the production process, for example ring spinning machines.

As depicted, the workstations of such roving frames 51 usually have two rotatable roving frame flyers 53 in one flyer bench 52, which are usually supplied by an upstream three-roller drafting system 5.

In the present embodiment example, there is also a channel compactor 40 in accordance with the invention positioned in the area of the pre-drafting field 32 of the drafting system 5.

As can be seen, a sliver 4 that is drawn from a (not shown) spinning can 3 by an intake roller pair 22, which consists of an upper roller 18 and a lower roller 19, is drawn into drafting system 5, and is finally transported to drafting system 5 and drafted by means of the additional roller pairs 26, 28 of drafting system 5.

As is standard, the roller pairs 26, 28 are each composed of a top roller 21 or 23 and a bottom roller 27 or 29 whereby, looked at in the running direction F of the sliver 4, the first two roller pairs 22, 26 form a pre-drafting field 32, in which a channel compactor 40 is positioned and is designed in accordance with the invention.

The roller pairs 26, 28 form the connected main drafting field 34 of the drafting system 5, whereby the roller pair 28 also represents the exit roller pair 28 of the drafting system 5.

The sliver 4 is transported through the roller pairs 22, 26 and 28 to the roving frame flyer 53, which is located on a rotatable flyer bench 52, and is thereby drafted, because the circumferential speeds of the roller pairs 22, 26, 28 increase in the running direction F of the sliver 4.

The rotating roving frame flyer 51 also ensures that the drafted sliver is twisted slightly, i.e. it becomes a so-called shaped roving frame fibre.

As with the drafting systems for air spinning units, the channel compactor 40, positioned in the area of the pre-draft field 32 in accordance with the invention, also ensures that the sliver 4, which is initially running into the drafting system 5 in a flat horizontal direction, is twisted in, for example, a vertical direction when it runs through the channel compactor 40.

It does this by means of its screw-shaped guide channel 35. The sliver 4 thereby temporarily receives a false twist, which leads to the compacting of the sliver 4 on all sides.

This compacting of the sliver 4 on all sides is not only maintained as the sliver 4 is running through the drafting system 5, but rather in the area of the roller pairs 26, 28 a compacting of the vertically positioned sliver 4 occurs with the result that there is further increased integration of the edge fibres into the sliver 4.

The roving frame thread is significantly more compact and less hairy than previously known roving frame threads, which means that the roving frame thread can be better processed during the subsequent work process on a ring spinning machine. This means that, during the processing of such compact and less hairy roving frame threads, spinning triangles occur on the spinning positions of the ring spinning machines that are minimised as regards their width, which represents a significant improvement in the quality of the roving frame threads.

FIG. 6 shows, on a larger scale and in a perspective view, an initial embodiment of a channel compactor 40 in accordance with the invention, which preferably is manufactured in a 3D printing process from an abrasion-resistant plastic.

As can be seen, the channel compactor 40 has a guide channel 35 with an entry opening 36 and an exit opening 37, whereby the entry opening 36, is positioned horizontally in the casing of the channel compactor 40.

This means that the entry opening 36 of the channel compactor 40 has its greatest width horizontally, when the channel compactor 40 is attached to the relevant drafting system construction, for example by means of locking devices 41.

In this mounted state a sliver 4, the running direction of which is labelled with F in FIG. 5, can run into the guide channel 35 of the channel compactor 40 in a flat, horizontal direction through the entry opening 36.

Because the exit opening 37 is positioned at an angle $\alpha$ with respect to the entry opening 36, in the embodiment example of FIGS. 6, 7, 8 and 9 at 90°, the sliver 4 is also twisted when running through the channel compactor 40 and has a vertical direction after running out of channel compactor 40.

According to the embodiment examples in FIGS. 6 and 7, the guide channel 35 has a light cross-section area, which is formed by two narrowing ellipses 38 extending towards the centre from both sides. This means that there are flange-like protrusions 39 between the ellipses 38.

Such a design ensures an even, secure guiding of the sliver 4 through the channel compactor 40 during its passage.

FIG. 7 shows a front view of the channel compactor 40 in accordance with the invention pursuant to FIG. 6.

As can clearly be seen here, the exit opening 37 is positioned at an angle of a with respect to the entry opening 36. The angle $\alpha$ has a measurement in the embodiment example of, for example, 90°. However, other angles between, for example, 30° and 160° are also possible.

FIGS. 8 and 9 show further possible embodiments of a channel compactor 40 according to the invention.

FIG. 8 shows a channel compactor 40, the guide channel 35 of which has a maximum width of B in the area of its horizontally positioned entry opening 36. As, can be seen, this maximum width B then reduces throughout the guide channel 35 and has its final minimum width of B−X in the area of the exit opening 37, which is arranged rotated in a vertical direction compared to the entry opening 36.

FIG. 9 shows a channel compactor 40, which is comparable in principle. In this embodiment, the guide channel 35 of the channel compactor 40 has a minimum width of $B_1$ in the area of its horizontally positioned entry opening 36.

This minimum width $B_1$ then reduces through the guide channel 35 and has its final maximum width $B_1$+X in the area of the exit opening 37, which is arranged rotated in a vertical direction compared to the entry opening 36.

LIST OF REFERENCE NUMBERS

1 Air spinning machine
2 Spinning position
3 Spinning can
4 Sliver
5 Drafting system
6 Air spinning unit
7 Yarn take-up device
8 Yarn clearer
9 Yarn changing device
10 Yarn
11 Winding device
12 Operating unit
13 Rail
14 Rail
15 End frame
16 End frame
17 Cross-wound package
18 Top roller
19 Bottom roller
20 Top roller
21 Top roller
22 Entry roller pair
23 Top roller
24 Roller pair
25 Bottom roller
26 Roller pair
27 Bottom roller
28 Roller pair
29 Bottom roller
30 Apron
31 Apron
32 Pre-draft field
33 Mid-draft field
34 Main draft field
35 Guide channel
36 Entry opening
37 Exit opening
38 Ellipse
39 Protrusion
40 Channel compactor
41 Locking device
42 Nozzle device
43 Nozzle
44 Nozzle
45 Pneumatic line
46 Pressurised air source
47 Spinning cone
48 Air chamber
49 Pneumatic line
50 Negative pressure source
51 Roving frame
52 Flyer bench
53 Flyer
F running direction

What is claimed is:

1. A compactor device for compacting a sliver that is drawn through a drafting system of a textile machine,
characterised in that,
the compactor device is designed as a channel compactor and has a guide channel designed in a shape of a screw in a running direction of the sliver, wherein an entry opening of the guide channel is widest horizontally and an exit opening of the guide channel is arranged rotated at a rotation angle of at least 30° with respect to the entry opening,
wherein the guide channel has a cross-section area, which is depicted through two narrowing ellipses extending towards the centre from both sides.

2. The compactor device according to claim 1, characterised in that the rotation angle between the entry opening and the exit opening of the guide channel is between 30° and 160°.

3. The compactor device according to claim 2, characterised in that the rotation angle between the entry opening and the exit opening of the guide channel is 90°.

4. The compactor device according to claim 1, characterised in that the compactor device designed as a channel compactor is manufactured from an abrasion-resistant plastic in a 3D printing process.

5. The compactor device according to claim 1, characterised in that the channel compactor is positioned in an area of a pre-drafting field of the drafting system of an air spinning unit.

6. The compactor device according to claim 1, characterised in that the channel compactor is arranged in an area of a mid-drafting field of the drafting system of an air spinning unit.

7. The compactor device according to claim 1, characterised in that the channel compactor is positioned in front of an entry roller pair of the drafting system of an air spinning device.

8. The compactor device according to claim 1, characterised in that the channel compactor is arranged in front of an entry roller pair of the drafting system of a roving frame.

9. The compactor device according to claim 1, characterised in that the channel compactor is arranged in an area of the pre-drafting field of the drafting system of a roving frame.

10. The compactor device according to claim 1, characterised in that several channel compactors are arranged in various positions in the drafting system of the textile machine.

11. The compactor device according to claim 1, characterised in that the guide channel of the channel compactor has a maximum width in an area of its horizontally positioned entry opening that diminishes in size throughout the length of the guide channel having a minimum width in an area of the exit opening, which is arranged rotated in a vertical direction compared to the entry opening.

12. A compactor device for compacting a sliver that is drawn through a drafting system of a textile machine,
characterised in that,
the compactor device is designed as a channel compactor and has a guide channel designed in a shape of a screw in a running direction of the sliver, wherein an entry opening of the guide channel is widest horizontally and an exit opening of the guide channel is arranged rotated at a rotation angle of at least 30° with respect to the entry opening, wherein the guide channel of the channel compactor has a width in the area of a horizontally positioned entry opening that changes throughout the length of the guide channel, having a maximum width in the area of the exit opening, which is arranged rotated in a vertical direction compared to the entry opening.

* * * * *